US005626340A

United States Patent [19]

Phillips

[11] Patent Number: 5,626,340

[45] Date of Patent: May 6, 1997

[54] THREE DIMENSIONAL TOKEN GAME

[76] Inventor: Steven C. Phillips, 135 Gablo Rd., Paoli, Pa. 19301-1847

[21] Appl. No.: 630,922

[22] Filed: Apr. 5, 1996

[51] Int. Cl.[6] ..... A63F 3/00

[52] U.S. Cl. ..... 273/241

[58] Field of Search ..... 273/236, 241, 273/242, 243, 275, 284, 146, 288, 290

[56] References Cited

U.S. PATENT DOCUMENTS

| | | | |
|---|---|---|---|
| 3,674,274 | 7/1972 | Schur | 273/241 X |
| 3,692,310 | 9/1972 | Martin | 273/241 |
| 4,552,363 | 11/1985 | Rehkemper et al. | 273/241 |
| 4,573,688 | 3/1986 | Grimes | 273/241 |
| 4,717,154 | 1/1988 | Miller | 273/146 X |
| 4,776,597 | 10/1988 | Rudell | 273/241 |
| 5,048,840 | 9/1991 | Johnson | 273/241 |
| 5,456,472 | 10/1995 | Goodman | 273/241 |

FOREIGN PATENT DOCUMENTS

| | | | |
|---|---|---|---|
| 2645412 | 6/1977 | Germany | 273/241 |
| 2198359 | 6/1988 | United Kingdom | 273/241 |

*Primary Examiner*—William E. Stoll

[57] ABSTRACT

A three dimensional token game including a plurality of dice. Each die has four concave members with each concave member having a color painted thereon. Included are a plurality of player pieces for each of the game players. Each piece has a color. The color of any one player piece is identical to the color of one of the concave members of the dice. A plurality of field squares, for building and rearranging a playing field setup during the game, are included. Each field square is chosen by the player after each player rolls the dice. Each field square is a color, with the color of each field square identical to the color of one of the concave members of the dice. Each field square is stackable one on top of another field square, with a like color before game play. Each field square is positionable on a playing surface for creating the playing field setup. Lastly, a plurality of winning squares, positionable on the playing field at a line of field squares, are provided.

9 Claims, 3 Drawing Sheets

FIG 1
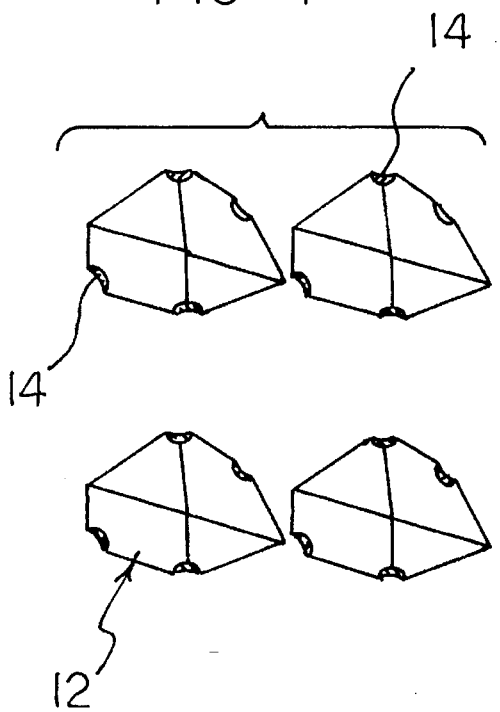
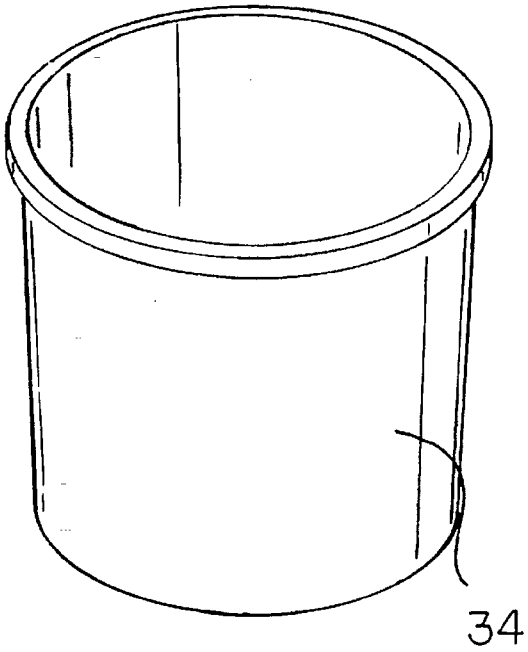
FIG 2
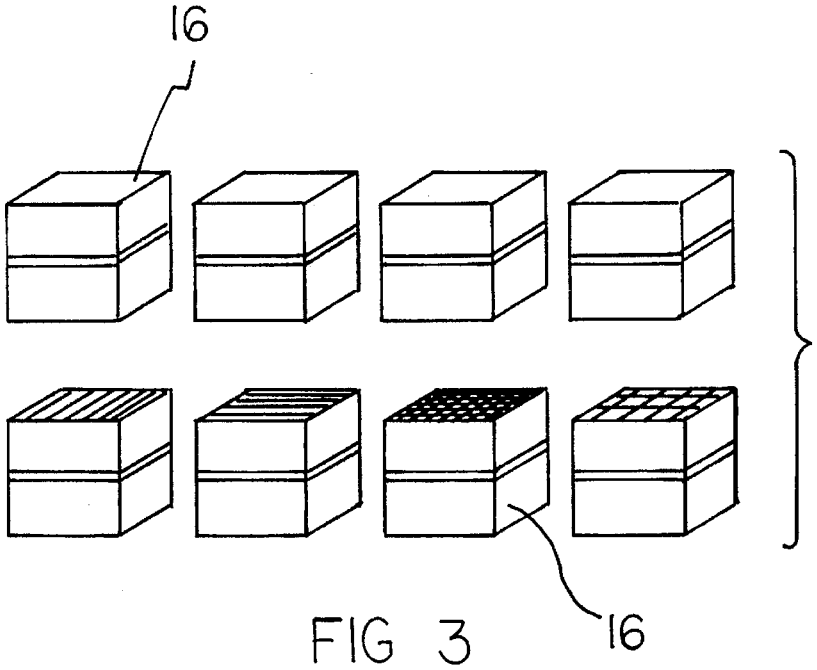
FIG 3

FIG 7
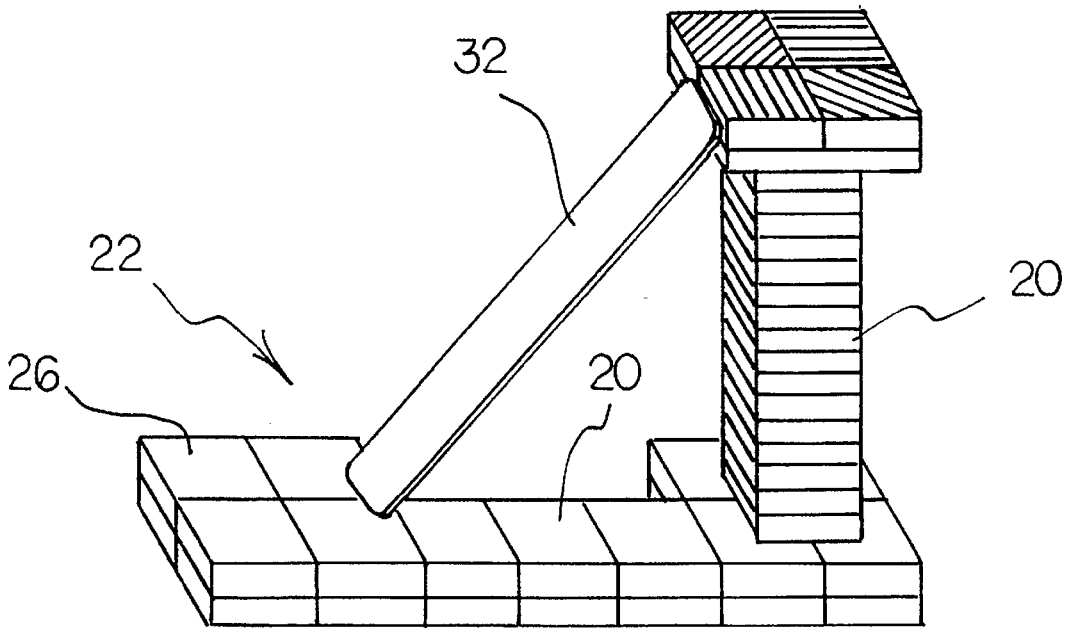
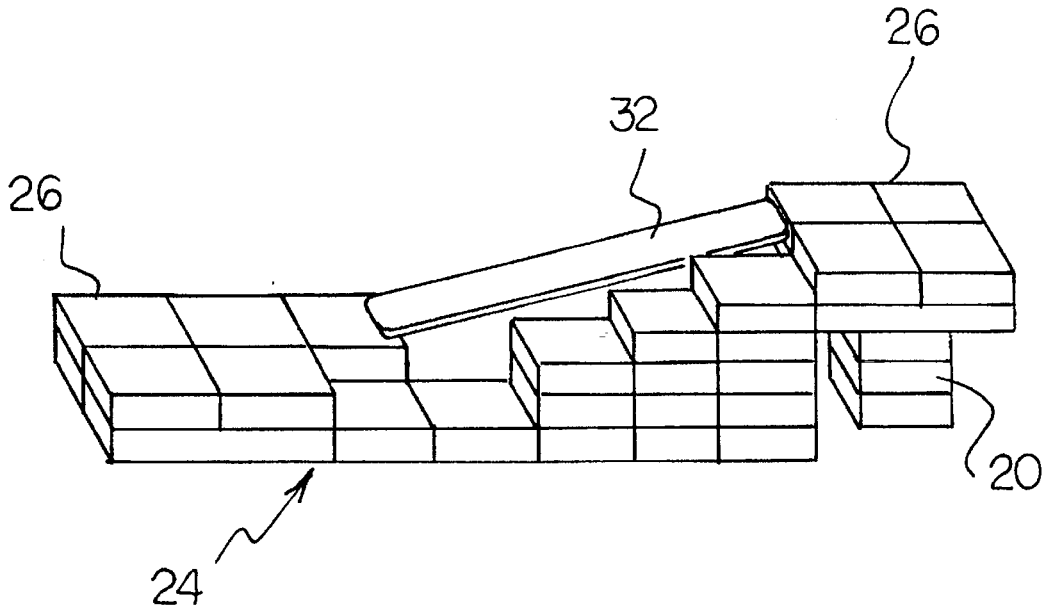
FIG 8

THREE DIMENSIONAL TOKEN GAME

BACKGROUND OF THE INVENTION

1. Field of the Invention

The present invention relates to a three dimensional token game and more particularly pertains to providing a token game wherein the field squares of the game are used to build and rearrange the playing field setup during game play, and a player wins by collecting four different colored squares earned by being on a four colored winning square, and rolling four different colored die.

2. Description of the Prior Art

The use of token games is known in the prior art. More specifically, token games heretofore devised and utilized for the purpose of entertainment are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,299,808 to Wood discloses a board game apparatus. U.S. Pat. No. 5,333,877 to Pridgeon, Green and Spector discloses a method of playing a board game. U.S. Pat. No. Des. 311,556 to Popek and Foster discloses a manipulative skills game board. U.S. Pat. No. 5,165,692 to D'Agostino discloses a game board with movable pieces. U.S. Pat. No. 5,145,184 to Yearick, Walsh and Muccini discloses a board game. Lastly, U.S. Pat. No. 5,118,113 to Ahlers and Ahlers discloses a board game.

While these devices fulfill their respective, particular objectives and requirements, the aforementioned patents do not describe three dimensional token game that allows the playing field setup of the token game to be built and rearranged during game play, and further allowing a player to win by being on a four colored winning square and rolling four of the same colored concave members of the dice, or by collecting four different colored field squares during game play.

In this respect, the three dimensional token game according to the present invention substantially departs from the conventional concepts and designs of the prior art, and in doing so provides an apparatus primarily developed for the purpose of providing a token game wherein the field squares of the game are used to build and rearrange the playing field setup during game play, wherein a player wins by collecting four different colored squares earned by being on a four colored winning square, and rolling four different colored die.

Therefore, it can be appreciated that there exists a continuing need for a new and improved three dimensional token game which can be used for providing a token game wherein the field squares of the game are used to build and rearrange the playing field setup during game play, wherein a player wins by collecting four different colored squares earned by being on a four colored winning square, and rolling four different colored die. In this regard, the present invention substantially fulfills this need.

SUMMARY OF THE INVENTION

In view of the foregoing disadvantages inherent in the known types of token games now present in the prior art, the present invention provides an improved three dimensional token game. As such, the general purpose of the present invention, which will be described subsequently in greater detail, is to provide a new and improved three dimensional token game and method which has all the advantages of the prior art and none of the disadvantages.

To attain this, the present invention essentially comprises a plurality of dice. Each die is generally hexagonal in shape. Each die has four concave members. One each concave member is positionable within one of four diametrically opposed corners of each dice. Each concave member has a color painted thereon, with the color chosen from a group of colors consisting of yellow, red, blue and black. Included are a plurality of player pieces. Each player piece has a box-like shape and provided to each of the game players. Each player piece has dimensions that are 1½ by 1½ inches. Each player piece is stackable one upon the other. Each player piece is a color chosen from the group of the colors consisting of blue, red, yellow and black. The color of any two player pieces is identical with one of the colors of the concave member of each die, included are a plurality of field squares. The field squares are for building and rearranging a playing field setup during game play. Four of the plurality of field squares are capable of being chosen by the player, upon each player rolling the dice. Each square is 1½ inch in length along each side, with a thickness of ⅜ inch. Each field square is a color chosen from the group of colors consisting of blue, red, yellow and black. Each field square is stackable one on top of another field square. Each field square is positioned in a line-up with one field square next to another field square on a playing surface to create the playing field setup. Each field square is positioned in the line-up with one field square next to another field square, and having one or more field squares stacked thereon to create the playing field setup. A plurality of winning squares are provided. Each winning square is positionable on the playing field at the end of the line-up of field squares, after play has begun. Each winning square has four equal portions. Each portion, of each winning square, has a different color. The color of each portion is one of the chosen group of colors consisting of red, blue, yellow and black. Each winning square has a diameter of 3 inches and a thickness of ¾ inch. Also, an elongated measuring stick is provided. The measuring stick aides the player in maintaining a distance between any two of the plurality of winning squares that are positioned adjacent one of the field squares. Lastly, a generally cylindrical cup is included. The cup is used to shake up the plurality of dice prior to being rolled on the playing surface. Wherein, the dice, when rolled onto the playing surface from within the cup by each player, helps to determine which of the players will make the first move of the game.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved three dimensional token game which has all of the advantages of the prior art token games and none of the disadvantages.

It is another object of the present invention to provide a new and improved three dimensional token game which may be easily and efficiently manufactured and marketed.

It is further object of the present invention to provide a new and improved three dimensional token game which is of durable and reliable constructions.

An even further object of the present invention is to provide a new and improved three dimensional token game which is susceptible of a low cost of manufacture with regard to both materials and labor, and which accordingly is then susceptible of low prices of sale to the consuming public, thereby making such three dimensional token game economically available to the buying public.

Still yet another object of the present invention is to provide a new and improved three dimensional token game which provides in the apparatuses and methods of the prior art some of the advantages thereof, while simultaneously overcoming some of the disadvantages normally associated therewith.

Even still another object of the present invention is to provide a three dimensional token game for providing a token game wherein the field squares of the game are used to build and rearrange the playing field setup during game play, wherein a player wins by collecting four different colored squares earned by being on a four colored winning square, and rolling four different colored die.

Lastly, it is an object of the present invention to provide a new and improved three dimensional token game including a plurality of dice, with each dice having a generally hexagonal shape. Each dice has four concave members with each concave member having a color painted thereon, included are a plurality of player pieces for each of the game players. Each piece has a box-like shape and a color. The color of any two player pieces is identical to the color of one of the concave members of the dice. A plurality of field squares, for building and rearranging a playing field setup during the game, are included. Each field square is chosen by the player after each player rolls the dice. Each field square is a color, with the color of each field square being identical to the color of one of the concave members of the dice. Each field square is stackable one on to of another field square, having a like color before game play. Each field square is positionable on a playing surface for creating the playing field setup. Lastly, a plurality of winning squares that are positionable on the playing field are provided. The winning squares are positionable at the end of a line of field squares after play has begun. Each winning square has four equal portions, with each portion having a different color. The color of each portion is identical to the color of one of the concave members of the dice.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric view of the dice of the present invention.

FIG. 2 is a perspective view of the cup of the present invention.

FIG. 3 is an isometric view of the player pieces of the present invention.

FIG. 7 is a side elevational view of one orientation of the field squares in a playing field setup.

FIG. 8 is a side elevational view of a different orientation of the field squares arranged in the playing field setup.

The same reference numerals refer to the same parts through the various Figures.

DESCRIPTION OF THE PREFERRED EMBODIMENT

Figure 4:
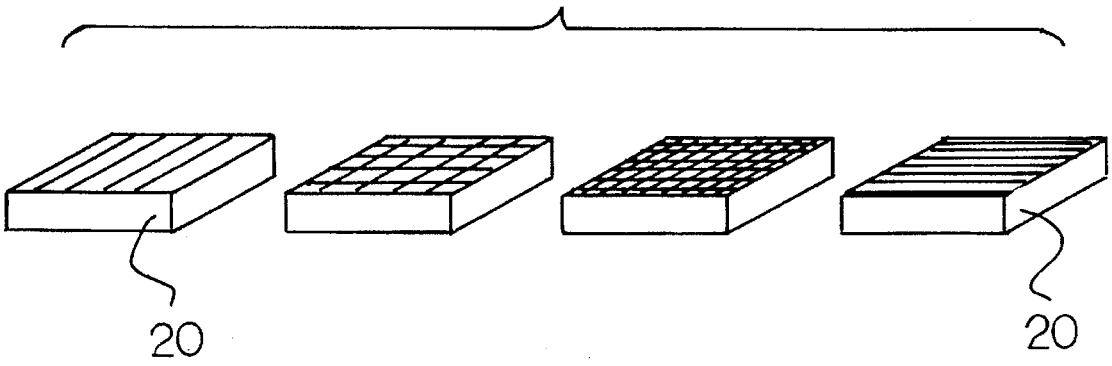
FIG. 4 is an isometric view of the field squares of the present invention.

With reference now to the drawings, and in particular to FIGS. 1–8 thereof, the preferred embodiment of the new and improved three dimensional token game embodying the principles and concepts of the present invention and generally designated by the reference numeral 10 will be described.

The present invention, the three dimensional token game 10 is comprised of a plurality of components. Such components in their broadest context include dice, player pieces, field squares and winning squares. Such components are individually configured and correlated with respect to each other so as to attain the desired objective.

Specifically, the present invention includes a plurality of dice 12 as seen in FIG. 1. The game includes four dice with each die being generally hexagonal in shape. All four dice are rolled together at all times by each player during the game player. Each die has four concave members 14. One each concave member is positionable within one of four diametrically opposed corners of each die. Each concave member has a color painted thereon, with the color chosen from a group of colors consisting of yellow, red, blue and black. Each die may be formed from wood, ceramic, plastic or metal. The exterior surface of each die is coated with a clear polyurethane to extend the useful life of the die. The polyurethane will keep the paint on the concave members from peeling so readily.

Also, a plurality of player pieces 16 are provided for each of the game players. The game includes eight player pieces. Each player piece has a box-like shape. Each player piece has dimensions being 1½ by 1½ cubic inches. Each player piece is stackable one onto another of the player pieces. Each player piece has a color chosen from the group of the colors consisting of blue, red, yellow and black. The color of any two player pieces is identical with one of the colors of the concave member of each die to match the color of one of the concave members of each die.

Additionally, a plurality of field squares 20 are provided. The game includes at least forty-four field squares of each color for game play. The plurality of field squares are for building and rearranging a playing field setup 22 and 24 during game play. Four of the plurality of field squares are chosen by the player upon each player rolling the dice 12. Each square is 1½ inch in length long each side with a thickness of ⅜ inch. As seen in FIG. 4, each field square is a color chosen from the group of colors consisting of blue, red, yellow and black. Each field square is stackable one on top of another field square that has a like color, before the game starts.

During the game, the player pulls four field squares from the stacks. The four field squares that are chosen by the player, must match the color of the concave member after the dice are rolled. Each field square is positioned in a line-up with one field square next to another field square on a playing surface for creating the playing field setup 22, as shown in FIG. 7. Each field square is positionable in the line-up with one field square next to another field square, and one or more field squares stacked thereon, as seen in FIG. 8, to create another playing field setup 24. The placing of the field squares, during game play, creates the playing field setup. Because there is no set structure for the playing field setup, movement about the field setup varies greatly.

Figure 5:
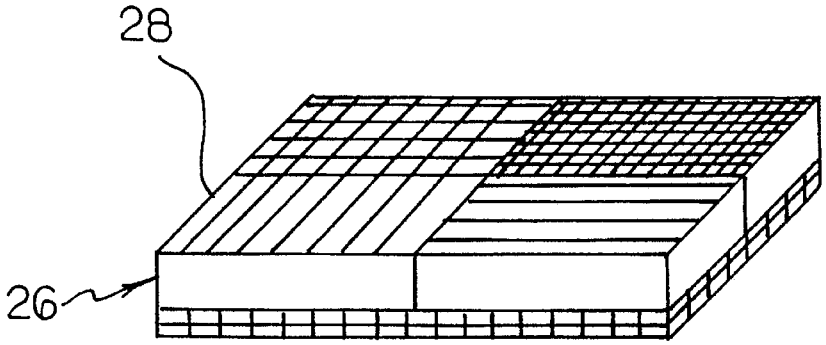
FIG. 5 is an isometric view of the winning squares of the present invention.

As best illustrated in FIG. 5, a plurality of winning squares 26 are provided. The winning squares are for positioning on the playing field at the end of the line-up of field squares, as seen in FIGS. 7 and 8, after play has begun. The game includes four legal winning squares, but other winning squares may be made from the field squares 20. Each winning square has four equal portions 28. Each portion has a different color. The color of each portion is one of the chosen group of colors consisting of red, blue, yellow and black. Each winning square has a diameter of 3 inches and a thickness of ¾ inch.

Figure 6:
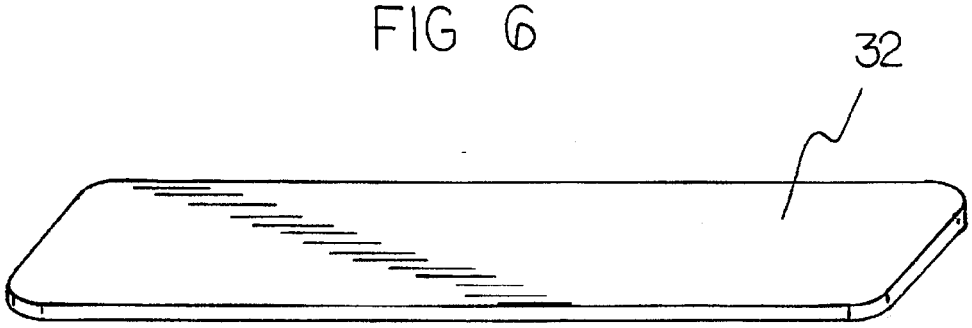
FIG. 6 is a side elevational view of the measuring stick of the present invention.

An elongated measuring stick 32 is included and shown in FIG. 6. The measuring stick is to ensure that a distance between any two of the plurality of winning squares is maintained. When the winning squares are positioned adjacent one of the field squares, they are required to be eight squares apart or a distance slightly greater than the measuring stick. In FIGS. 7 and 8, the measuring stick is shown in a functional position.

Lastly, a generally cylindrical cup 34 is used to shake up the plurality of dice prior to rolling them onto the playing surface. Wherein, the dice, when rolled onto the playing surface from within the cup by each player, determines which of the players will make the first move of the game. The dice, also, determine which field squares will be chosen by each player.

The method of playing the three dimensional token game comprises of the following steps. Game play begins by first dumping out all of the game pieces onto the playing surface. Once the pieces are dumped, the plurality of field squares are stacked up according to like colors away from the central playing field. Each player is then provided with playing pieces, with one playing piece going to each player. The players are capable of moving the playing pieces on top of the field squares once they have been positioned on the playing surface.

The plurality of winning squares are then set aside for later use during the game as play progresses. The plurality of dice are placed within the cup for shaking and being tossed out of to begin game play. The dice are rolled onto the playing surface of a first player. When the dice have stopped movement, each dice has a colored concave member facing upwardly toward the player. The player then chooses four of the plurality of field squares from the stack based upon the colors of the concave members being shown. The field squares chosen by the first player is then lined up on the playing surface. Once the field squares are placed on the playing surface, the playing piece is moved onto the field squares and is allowed to rest on the last field square on the playing surface.

The first player to roll, begins to create the playing field setup. The remaining players make the same identical movements as the first player. The remaining players shake the dice up in the cup, roll the dice onto the playing surface and choose four field squares based upon the colors of the concave members of the dice. Each time one of the remaining players chooses the field squares, that remaining player places those field squares beside of or on top of the field squares currently on the playing surface. After which, the remaining player begins moving his playing piece across those field squares to allow his playing piece to either rest on another player's playing piece or a field square.

Each remaining player is required to start movement of their playing piece at the identical field square as the first player to move. Each remaining player is allowed to move four to eight of the field squares that are on the playing surface. The players are allowed to add winning squares when one of each player rolls the plurality of dice, and the plurality of dice land with identical colored concave members facing upwardly. Also, adding winning squares is allowed to occur, when one of each player rolls a plurality of dice, and the plurality of dice each have a different colored concave member facing upwardly.

The winning squares, are added to any position on the playing field setup that has been formed by the field squares. Each winning square is required to be positioned slightly more than the measuring stick distance from another winning square on the playing field. Each winning square, can be required to be positioned eight field squares from any other winning square.

Finally, winning occurs when any one of the players rolls the plurality of dice, and the plurality of dice have four identical colored concave members facing upwardly. While, the player is positioned on the winning square and no player pieces or field pieces are stacked on the player's piece. Additionally, winning may occur when anyone of the players, during game play, collects four different colored field squares.

RULES OF THE GAME

The following set of rules are provided as the preferred manner of playing the game. However, variation of rules and manner of playing the game are within the scope of this invention.

Reading The Dice And Picking Up Squares a. Roll the dice and pick up the matching colored field squares from the stack. The color on top of the dice is the color indicated.

b. Then in combination with the field and picked up squares move your piece onto colors that match.

c. The first time a color is used, either when moving onto a like colored square on the field or adding a square and moving onto that square. Move the matching colored die to the side, which means that die is out of play for the rest of the turn.

d. This gives the players a minimum number of four moves and a maximum number of moves of eight.

e. Any picked up square possessed after it is colored die is out of play, is used normally and moved onto.

Basic Moves

The basic moves of the player's piece are across diagonal, climbing up one square at a time, directed assent by placing squares under a player's piece so that one player can rise the level another player's piece and jumping down.

Climbing On An Opponent a. When climbing on an opponent's piece, the height of that piece does not matter.

b. The color of their piece does count as the color of the square.

c. A player can climb on a game piece starting one square down when the opponent's piece matches the color of a die in play.

d. A player starting at the same level can climb on a piece that does not match a die Color by adding a square and moving onto that square. (If the player's piece is at the same level and the piece does not match a die color, then no square is required.)

e. A player may ascend their piece to meet the condition of the move.

f. Though the height of the player's piece does not count in climbing, once on top it's height can be used.

Removing Squares From Your Back a. A player rolls the die and picks up the matching colored squares off the piece's back from the top down. The reminder of the squares needed are removed from the stacks and then the player moves normally.

b. All squares must be off a piece's back in order for that piece to move.

c. If only top squares can be removed, leaving one or more still on a piece's back, the player can put the removed squares anywhere on the playing field. The player removing the squares of his/hers piece cannot place the squares onto another player's piece and he/she cannot move their playing piece.

d. If only squares under a top square match the die, the player does nothing.

Adding Winning Squares a. A winning square is four different colored squares put together.

b. A winning square can be made by putting a field squares together.

c. A winning square must remain pure in the colors stacked onto it. That is red on red, blue on blue, yellow on yellow and black on black. This must occur for the winning square to remain a winning square.

d. A winning square can be turned into a unwinning square by putting a different color on that square. As long as the winning square is not pure in its stacking, it is not considered a winning square.

e. An official winning square if four different colored squares fixed together.

f. An office winning square must remain pure throughout the game.

g. A roll of four of a kind adds a winning square. Also, the player receives an additional field square of their choice.

h. A roll of four different colored die adds a winning square. If the player is on a winning square, they receive a same colored square.

i. Winning squares are added measuring stick apart.

j. When adding a winning square, the player picks up four squares of each color and connects the winning square to the field squares.

k. Squares can be added across or diagonally then the winning squares are placed at the end.

l. Squares can be added by stacking and then placing the winning squares on top.

m. Squares can be added in combinations of across, diagonally and stacking, then the winning square is placed appropriately.

A Roll of Four Different Colors a. A player who rolls four different colored dice when he/she are on a winning square, with no squares or players on their back, receives a square. The color of the square that he/she receives must match the color of the square on which the player's piece rests. The player then adds another winning square and places their piece on one of the colors and rolls four times.

a.1 If a four different roll happens again, the player collects another square which matches the color that their piece is on and they may move to another colored winning square.

b. If a player collects four different colored squares, that player is named the winner.

c. When a player rolls four different colors and has no squares or player's pieces on his/her back, they add a winning square. The player can then place their piece onto a color of that winning square and roll four more times.

d. When a player rolls four different colors, the player may remove all squares and players from their playing piece's back. The removed squares can be placed anywhere on the field, but not on another player's piece. The removed players can be put on other player's pieces or anywhere else on the game field.

e. At times, when a player is on a winning square, either because of a four different colored roll or a four of a kind roll, the player rolls only four times. The player does not leave that winning square.

f. A player wins the game if he/she rolls a four of a kind if, the player is on a winning square and has no squares or playing pieces on their back, after all four winning squares are added.

g. A player can not win with squares or playing pieces on their backs.

h. When a player roll four of a kind, it removes all squares and player's pieces from his/her back. The removed squares can be placed anywhere on the playing field except onto another player's piece. The removed player's pieces can also be put anywhere on the playing field. The removed player's piece can also be placed onto another player's piece.

i. When a player rolls a four of a kind, has no squares or player's pieces on their backs and is off a winning square, receives a color square of their choice and adds a winning square. The player then goes to that winning square and rolls four times more.

j. Exception: If a player has three of the four squares, the player can still receive their final square and adds a winning square, but they do not move. On that player's next turn, they try to move onto a winning square where the player then wins.

k. During a player's turn, they can move onto a winning square from the field. On the player's next turn, if he/she does not roll a four of a kind, they must leave the winning square or go at least measuring stick away before returning to the same winning square.

First and Second Parts of the Game a. The first part of the game includes building the field by adding winning squares, removing squares, building stacks and removing squares from stacks according to the turns and rolls.

b. On the first four opportunities, players must add the official winning squares.

c. Once a colored field squares stack is gone, then that colored square is picked up from the field.

d. Once all stacks of field squares or winning squares are added to the field, the second part of the game begins, thus rearranging the playing field.

e. During the second part of the game, square are picked up from the field from the top down, then readded to the field. Also, any winning squares has now changed to moving them. Any squares or players on the winning square go with it on the move.

f. Also, in the second part of the game, there is a change in rule of squares removed from a player's back can now be placed on other player backs or anywhere else on the field.

g. Another change in the second part of the game includes a "Roll Off". When a player moves onto winning square from the field, they can challenge all other players on winning squares to a "roll off". Wherein each player rolls four times trying to win or collect squares.

h. It there are no other players on winning squares, or if the player can incapacitate their opponents by placing squares on the other player's backs, they get to "roll off" themselves.

i. If a player wins early in the game, or if players just wish to continue playing the game without dismantling the game field is permissible.

j. The winning player is allowed to take a field square into the next game. The same is true for each additional win. That is if a player wins two games, he can take two field squares into the next game. If the player wins three games, he can take three squares into the next game, and so on.

Let's Play a. One to four players can play by picking one of four colors.

b. Five to eight players may play by marking cousins pieces to differentiate.

c. The game can be played with teams. They all move independently of each other on the same roll of the dice.

d. Stack all colored field pieces off the playing surface in like stacks.

e. Players may pick colors or roll the dice.

f. The highest roll of the dice determines the player who begins the game.

g. All players start from the same square.

h. An example of a first move would be as follows, the player would roll the dice, pick up squares and place them on the playing surface in a line and move their playing piece to the end of that line.

i. The following players move following the basic moves and rules of the game.

The basic idea is that players move from winning square to winning square trying to collect four squares to win. There are major rolls and minor rolls of the dice. Major rolls of the dice are rolls of four different colors and rolls of four of a kind same color. Any roll that is not major is a minor roll. Minor rolls are basic move rolls. Keep collected squares separate from the basic moving squares. A major roll starts a cycle of rolling that does not stop until the player rolls for consecutive minor rolls. A major roll earns a player a square for their collection if they have no squares or players on their back. A major roll adds an Official Winning square, at which time the player goes there and continues to ross the dice. (when a player has no squares or players on their back) A major roll can move all squares and players from a players back. After all four Official Winning Squares are added, there are Roll Offs. A Roll Off is a challenge between players on winning squares, where each roll the dice four times only. After Roll Offs have been added to the game, a roll of four of a kind can win the game instantly.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved three dimensional token game in which players build a playing field for game movement while the game progresses comprising in combination:

a plurality of dice with each die having four concave members, one of each concave member being positionable within one of four diametrically opposed corners of each die, each concave member having a color painted thereon with the color being chosen from a group of colors consisting of yellow, red, blue and black;

a plurality of player pieces having a box-like shape for each of the game players, each player piece having dimensions being 1½ by 1½ inches, each player piece being stackable one upon the other, each player piece being a color chosen from the group of colors consisting of blue, red, yellow and black for matching the color of any one of the player pieces with one of the colors of the concave member of each die;

a plurality of field squares for building and rearranging a playing field setup during game play, four of the plurality of field squares being capable of being chosen by the player upon each player rolling the dice, each square being 1½ inch in length with a thickness of ⅜ inches, each field square being a color chosen from the group of colors consisting of blue, red, yellow and black, each field square being stackable one on top of another field square, each field square capable of being positioned in a line-up with one field square next to another field square on a playing surface for creating the playing field setup, each field square capable of being positioned in the line-up with one field square next to another field square, having one or more field squares stacked thereon for creating the playing field setup;

a plurality of winning squares for positioning on the playing field at the end of the line-up of field squares after play has begun, each winning square having four equal portions with each portion having a different color, the color of each portion being one of the group of colors consisting of blue, red, yellow and black, each winning square having a length of 3 inches and a thickness of ¾ inch;

an elongated measuring stick for maintaining a distance between any two of the plurality of winning squares being positioned adjacent one of the field squares; and a generally cylindrical cup for shacking up the plurality of dice prior to being rolled onto the playing surface, wherein the dice being rolled onto the playing surface from within the cup by each player for determining which of the players will make the first move of the game.

2. A three dimensional token game comprising:

a plurality of dice with each die having four concave members with each having a color painted thereon;

a plurality of player pieces having a box-like shape for each of the game players, each player piece being a color with the color of any one players piece being identical to the color of one of the concave members of the dice;

a plurality of field squares for building and rearranging a playing field setup during game play, each field square being capable of being chosen by the player upon each player rolling the dice, each field square being a color with the color of each field square being identical with the color of one of the concave members of the dice, each field square being stackable one on top of another field square having a like color before game play, each field square being positionable on a playing surface for creating the playing field setup; and a plurality of winning squares for positioning on the playing field at the end of a line-up of field squares after play having begun, each winning square having four equal portions with each portion having a different color, the color of each portion being identical to the color of one of the concave members of the dice.

3. The token game as set forth in claim 2, wherein each concave member of the plurality of dice being positionable within one of four diametrically opposed corners of each die, and the color of each concave member being chosen from a group of colors consisting of yellow, red, blue and black.

4. The token game as set forth in claim 3, wherein each player piece having dimensions being 1½ by 1½ inches, and each player piece being stackable one upon the other.

5. The token game as set forth in claim 4, wherein each square being 1½ inch in length with a thickness of ⅜ inches, each field square capable of being positioned in a line-up with one field square next to another field square on the playing surface for creating the playing field setup, each field square capable of being positioned in the line-up with one field square next to another field square and having one or more field squares stacked thereon for creating the playing field setup.

6. The token game as set forth in claim 5, wherein each winning square having a length of 3 inches and a thickness of ¾ inch.

7. The token game as set forth in claim 2, further including an elongated measuring stick being capable of ensuring that a distance is maintained between any two of the plurality of winning squares being positioned adjacent one of the field squares.

8. The token game as set forth in claim 2, further including a generally cylindrical cup for shacking up the plurality of dice prior to being rolled onto the playing surface.

9. A method of playing a three dimensional token game in which players build a playing field for game movement while the game progresses comprising the steps of:

stacking a plurality of field squares having like colors on a playing surface and away from a central playing field;

providing a plurality of player pieces with one each for each player, the player pieces being capable of moving on top of the field squares being positioned on the playing surface;

providing a plurality of winning squares with one of each winning square being positionable on the playing surface and adjacent one of the field squares during game play;

providing a plurality of dice with each dice having colored concave members on diametrically opposed corners thereof, the color of the concave member being chosen from a group of colors consisting of yellow, red, blue and black, play beginning by each player taking a turn rolling the dice for determining which player will move first;

rolling of the plurality of dice onto the playing surface by a first player, the plurality of dice coming in contact with the playing surface and allowing one of the colored concave members of each dice to face upwardly, the first player choosing four of the plurality of field squares, from the stack of field squares, as determined by the colored concave member facing upwardly from the playing surface;

placing the chosen field squares, of the first player to roll the plurality of dice, onto the playing surface in a line, the chosen field squares of the first player to move starting to form a playing field setup, the first player to move, having placed the chosen field squares on the playing surface, moves across each chosen field square, the player moves allowing his player piece to rest on the fourth field square lined on the playing surface;

remaining players move following the identical movements as the first player to move, the remaining players being capable of lining their chosen four field squares adjacent the first players field squares in a planar orientation, the remaining players being capable of stacking their chosen four field squares on top the chosen field squares of the first player to move, each remaining player having being required to start movement of their playing piece at the identical field square as the first player to move, each remaining player beginning at the identical field square and moves four to eight of the field squares;

adding winning squares being capable of occurring when one of each player rolls the plurality of dice and the plurality of dice each have an identical colored concave member facing upwardly, adding winning squares being capable of occurring when one of each player rolls the plurality of dice and the plurality of dice each have a different colored concave member facing upwardly;

the winning squares being added to any position on the playing field setup being formed by the field squares, each winning square being required to be positioned slightly more than a measuring stick distance from another winning square on the playing field setup; and winning occurring when any one of the players rolling the plurality of dice and the plurality of dice have four identical colored concave members facing upwardly, while the player being positioned on the winning square and no player pieces or field pieces being stacked on their piece, and winning occurring when any one of the players during game play collects four different colored field squares.

* * * * *